US006223877B1

(12) United States Patent
McGinty et al.

(10) Patent No.: US 6,223,877 B1
(45) Date of Patent: May 1, 2001

(54) COIN VALIDATION APPARATUS

(75) Inventors: Joseph R. McGinty, Madison; Steven Michael Faes, Huntsville; Gregory Lee Distler, Huntsville; Eugene Gray Heathershaw, Hunstsville; Gary Grantland, Huntsville, all of AL (US)

(73) Assignee: QVEX, Inc., Madison, AL (US)

( * ) Notice: Subject to any disclaimer, the term of this patent is extended or adjusted under 35 U.S.C. 154(b) by 0 days.

(21) Appl. No.: 08/902,569

(22) Filed: Jul. 29, 1997

Related U.S. Application Data

(60) Provisional application No. 60/043,715, filed on Apr. 16, 1997, and provisional application No. 60/022,386, filed on Jul. 29, 1996.

(51) Int. Cl.[7] ..... G07D 5/02; G07D 5/08

(52) U.S. Cl. ..... 194/317; 194/334; 194/335

(58) Field of Search ..... 194/317, 318, 194/319, 328, 334, 335; 453/4

(56) References Cited

U.S. PATENT DOCUMENTS

| | | |
|---|---|---|
| 3,481,443 | 12/1969 | Meloni . |
| 3,796,295 | 3/1974 | Montolivo . |
| 3,870,137 | 3/1975 | Fougere . |
| 3,901,368 | 8/1975 | Klinger . |
| 3,918,563 | 11/1975 | Schwippert . |
| 3,918,564 | 11/1975 | Heiman . |
| 3,952,851 | 4/1976 | Fougere . |
| 3,966,034 | 6/1976 | Heiman . |
| 4,082,099 | 4/1978 | Iwerson . |
| 4,089,400 | 5/1978 | Gregory, Jr. et al. . |
| 4,124,110 | 11/1978 | Hovorks . |
| 4,128,158 | 12/1978 | Dautremont . |
| 4,226,323 | 10/1980 | Dautremont . |
| 4,234,071 | 11/1980 | Le-Hong . |
| 4,254,857 | 3/1981 | Levasseur . |
| 4,267,916 | 5/1981 | Black et al. . |
| 4,334,604 | 6/1982 | Davies . |
| 4,353,453 | 10/1982 | Partin . |
| 4,354,587 | 10/1982 | Davies . |

(List continued on next page.)

FOREIGN PATENT DOCUMENTS

| | | |
|---|---|---|
| 0 155 126 A2 | 9/1989 | (EP) . |
| 0 331 530 A2 | 9/1989 | (EP) . |
| WO 92/09056 | 5/1992 | (WO) . |
| WO 92/18952 | 10/1992 | (WO) . |
| WO 95/19018 | 7/1995 | (WO) . |

*Primary Examiner*—F. J. Bartuska
(74) *Attorney, Agent, or Firm*—Gardner Groff Mehrman & Josephic, P.C.

(57) ABSTRACT

A coin validation mechanism for evaluating coins and the like inserted therein and for validating acceptable coins includes a coin chute defining a coin path and a sensor for evaluating the type of material of which the object in the coin chute is made of. The sensor for evaluating includes a coil sensor positioned adjacent the coin path and a non-resonant electrical circuit for operation of the coil sensor. The coin validation mechanism also includes a light source for directing light across the coin path and a light sensor for sensing light directed across the coin path. An electronic unit is provided for evaluating an electromagnetic perturbation caused by an object moving past the coil sensor and for determining the amount of light blocked by the object in the coin path by comparing the amount of light sensed by the light sensor with the object in the coin with the amount of light sensed by the light sensor in the absence of an object in the coin path. The electronic unit further compares the amount of light blocked by the object in the coin path and the electromagnetic perturbation with known values for valid coins to evaluate whether the object in the coin path is a valid coin or not.

22 Claims, 7 Drawing Sheets

U.S. PATENT DOCUMENTS

| | | | | |
|---|---|---|---|---|
| 4,359,148 | | 11/1982 | Davies . | |
| 4,361,218 | | 11/1982 | Van Dort . | |
| 4,398,626 | | 8/1983 | Barnes . | |
| 4,413,718 | | 11/1983 | Dean . | |
| 4,416,365 | | 11/1983 | Heiman . | |
| 4,436,196 | | 3/1984 | Crisp et al. . | |
| 4,460,003 | | 7/1984 | Barnes . | |
| 4,474,281 | | 10/1984 | Roberts et al. . | |
| 4,488,116 | | 12/1984 | Plesko . | |
| 4,509,633 | | 4/1985 | Chow . | |
| 4,531,625 | * | 7/1985 | Yonekura et al. | 453/4 X |
| 4,538,719 | | 9/1985 | Gray . | |
| 4,601,380 | | 7/1986 | Dean . | |
| 4,625,851 | | 12/1986 | Johnson . | |
| 4,667,093 | | 5/1987 | MacDonald . | |
| 4,678,994 | | 7/1987 | Davies . | |
| 4,706,020 | | 11/1987 | Viertl . | |
| 4,739,869 | | 4/1988 | Hoormann . | |
| 4,754,862 | | 7/1988 | Rawicz-Szcerbo . | |
| 4,809,838 | | 3/1989 | Houserman . | |
| 4,819,780 | * | 4/1989 | Trummer et al. | 194/317 |
| 4,837,511 | | 6/1989 | Whittington . | |
| 4,845,994 | | 7/1989 | Quinlin . | |
| 4,848,556 | | 7/1989 | Shah et al. . | |
| 4,879,360 | | 11/1989 | Collins . | |
| 4,895,238 | | 1/1990 | Speas . | |
| 4,936,435 | | 6/1990 | Griner . | |
| 5,028,870 | | 7/1991 | Reed . | |
| 5,033,602 | | 7/1991 | Saarinen et al. . | |
| 5,067,604 | | 11/1991 | Metcalf . | |
| 5,076,414 | * | 12/1991 | Kimoto | 194/334 X |
| 5,199,545 | | 4/1993 | Takamisawa . | |
| 5,213,190 | | 5/1993 | Furneaux . | |
| 5,293,979 | | 3/1994 | Kevasseur . | |
| 5,353,906 | | 10/1994 | Takamisawa . | |
| 5,379,876 | | 1/1995 | Hutton . | |
| 5,404,987 | | 4/1995 | Allan . | |
| 5,411,126 | | 5/1995 | Seitz . | |
| 5,460,256 | | 10/1995 | Levasseur . | |
| 5,515,960 | | 5/1996 | Wood . | |
| 5,538,123 | * | 7/1996 | Tsuji | 194/334 X |
| 5,542,520 | * | 8/1996 | Beisel et al. | 194/335 |

* cited by examiner

COIN VALIDATION APPARATUS

This application claims benefit of provisional applications 60/043,715, Apr. 16, 1997, and 60/022,386, filed Jul. 29, 1996.

TECHNICAL FIELD

The present invention relates generally to coin operated devices, such as pay telephones and more particularly relates to a coin validation apparatus for use with pay telephones.

BACKGROUND OF THE INVENTION

Coin operated devices have become very popular. Some examples of such are coin operated pay telephones, coin operated laundry machines, vending machines, parking meters, etc. One problem associated with such coin operated machines is that a wide variety of slugs have been developed in order to try to obtain products or services fraudulently from these coin operated machines without having to pay for the products or services.

In the past, it has been common to provide a mechanical mechanism for sorting and discriminating coins deposited in the coin operated device and for rejecting slugs. These mechanical discriminators typically have multiple passageways into which coins are directed depending upon their size. In known mechanical discriminators the mechanisms check both the diameter of the coin and its thickness. Unfortunately, the mechanical discriminators tend to be rather complex and are very prone to jamming. This requires a high number of service calls, at substantial expense. Also, use of these mechanical discriminators tends to be limited to certain predefined coin types and, once mechanical discriminators are made, they are not easily retrofitted to discriminate a new coin type. Also, because coin denominations take different coin paths within the mechanical discriminator, the limited space inside the discriminator tends to limit the variety of coins that can be discriminated thereby.

More recently, electronic coin discriminators have been developed. For example, U.S. Pat. No. 4,089,400 of Gregory, Jr. relates to a coin testing device in which multiple photo sensors (arrays thereof) are aligned along a coin path for determining the diameter of a coin passed therethrough. Gregory, Jr. describes that for each denomination to be tested, a separate series of photo sensor arrays is provided. This is necessary because each individual photo sensor in the array is simply providing information about whether it is covered or uncovered. Thus, to provide some modest level of precision in the measurement, a large number of photo sensor arrays are required for each denomination to be checked. In addition to Gregory, Jr., the following U.S. Pat. Nos. also disclose the use of an array of photo sensors: 4,267,916 of Black, et al.; 4,577,744 of Doucet; 4,667,093 of McDonald; 4,474,281 of Roberts, et al.; and, 4,076,414 of Kimoto.

In contrast to the use of one or more arrays of photo sensors, it has become known in the art to use a single photo sensor to measure diameter. For example, U.S. Pat. No. 4,531,625 of Yonekura. et al. relates to a coin diameter determining device in which a single light source is associated with a collimating lens to provide a collimated source of light. The diameter is then measured using multiple image sensors or photodetectors. While Yonekura et al. shows the use of a single lens arrangement, U.S. Pat. No. 4,848,556 of Shaw, et al. discloses the use of a dual lens arrangement so that a single infrared LED emitter can be used in conjunction with a single photodiode. According to the '556 patent, a collimating lens is placed between the LED emitter and the coin to be measured to collimate the light from the LED emitter. Another lens, this one a converging lens, is placed between the coin and the further diode. Other U.S. patents disclosing the use of a lens in connection with measuring the diameter of a coin include U.S. Pat. No. 5,033,602 of Saarinen, et al. and U.S. Pat. No. 5,033,603 of Kai, et al. One particular difficulty with the use of lenses is that they require precise orientation, installation, and calibration. Unfortunately, this makes it difficult to quickly and easily produce a repeatable product.

In addition to measuring the diameter of a coin, it has also been somewhat known in the art to measure the thickness of a coin passing through a discriminator. The mechanical discriminators mentioned above oftentimes are provided with means for determining the thickness of a coin, such as pincers or feelers or some other way of determining thickness. In the non-mechanical discriminators, it has been common to use some sort of mechanical or electromechanical device to determine the thickness of a coin. For example, in U.S. Pat. No. 4,577,744 of Doucet the discriminator uses stairstepped ramps or inclined ramps to change the position of a coin in the coin path according to the thickness of the coin. By noting which photo sensors of the array are covered and uncovered, and not just how many are covered or uncovered, the apparatus according to the '744 patent is able to discern the thickness of the coin passing therethrough. U.S. Pat. No. 4, 667,093 of McDonald discloses, in addition to the well-known use of an array of photo sensors, an additional photo sensor which is not aligned perpendicularly to the path of travel of the coin through the coin path, but rather is arranged at an angle thereto. In this way, the nominal "diameter" of the coin can be measured as a function of how long it takes to pass by the angled photo sensor. By comparing the thusly computed "diameter" with the diameter measured by the photo sensor array, the thickness of the coin can be deduced.

It has also been known in the art to use magnetic coils to try to evaluate the material of which the coin is made. For example, the following U.S. patents describe the use of magnetic coils for such a purpose: U.S. Pat. Nos. 4,577,744 of Doucet; 5,076,414 of Kimoto; 4,531,625 of Yonekura, et al.; 5,033,603 of Kai, et al.; and, 5,538,123 of Tsuji. Known material sensing apparatus generally disadvantageously employ an associated resonant circuit or tank circuit for operation of the magnetic coils. However, the use of a resonant or tank circuit has the disadvantage of frequency shifts with time and temperature.

Although the prior art shows numerous laudable efforts to provide an effective coin discriminator or coin validator, the prior art generally suffers from being too complicated, not rugged enough, and not jam-resistant enough. The known prior art also tends to have less than optimum accuracy in discriminating coins, rather low dynamic range in terms of the size of the coins that can be discriminated, a limited number of valid coin types can be discriminated, and often has only moderate sensitivity (precision of the measurement). In addition, the known prior art generally has difficulties when a coin or slug has a hole formed therein. Also, the known prior art tends to require high power levels, has difficulty in maintaining field accuracy, and can be difficult to manufacture with a high degree of repeatability. Accordingly, it is to the provision of a coin validator which overcomes these problems of the known prior art to which the present invention is primarily directed.

SUMMARY OF THE INVENTION

Briefly described, in a first preferred form the present invention comprises a coin validation apparatus for use with a pay telephone. The coin validation apparatus includes a coin chute defining a coin path, first and second means for directing light across the coin path, and first and second light sensors for sensing light directed across the coin path.

The first and second means for directing light across the coin path are arranged such that the light directed from each of them is substantially perpendicular to the other. The coin validation apparatus also includes electronic means for determining the amount of light blocked by an object in the coin path by comparing the amount of light sensed by the light sensor with an object in the coin path with the amount of light sensed by the light sensor in the absence of an object in the coin path. Further, the electronic means compares the amount of light blocked by the object in the coin path with known values for valid coins to evaluate whether the object in the coin path is a valid coin or not. Preferably, the coin path, the light source, and the light sensor are arranged such that light is directed toward the edge of the coin in the coin path.

Preferably, the light source and the light sensor and the electronic means can be used to evaluate a specific dimension or parameter of a coin. For example, the components can be provided for evaluating a circular area of the coin by looking at how much light is blocked by the face of the coin. Also, components can be provided for evaluating the material of the coin. One can provide a thin strip of light from the light source and have a light sensor that is adapted or configured for sensing such a thin strip of light directed across the coin path. Also, the coin chute, the second light source, and the second light sensor can be used to evaluate the thickness of a coin in the coin path.

Of course, one can combine these different measurement capabilities in a single apparatus such that the composition of a coin is evaluated, its diameter is evaluated, and its thickness is evaluated.

In another preferred form the invention comprises a coin validation apparatus for evaluating coins and includes a coin chute defining a coin path and a light source directing light across the coin path and at a rim of an object in the coin path. A light sensor is provided for sensing light directed across the coin path. Electronic means are used for determining the amount of light blocked by an object in the coin path, with the electronic means comparing the amount of light blocked by the object in the coin path with known values for valid coins to determine a thickness of the object to evaluate whether the object in the coin path is a valid coin or not.

In another preferred form, the invention comprises a coin validation apparatus, such as for use with a pay telephone, and comprises a coin chute and at least one sensor for measuring at least one physical characteristic of an object deposited in the coin chute. A first microprocessor is provided for evaluating measured physical characteristics to determine whether the object is a valid coin. A control means is provided which is responsive to the presence of an object in the coin chute for controlling operation of the first microprocessor such that the microprocessor is maintained in a dormant, unpowered state in the absence of an object in the coin chute and is powered up in the presence of an object in the coin chute.

In yet another preferred form, the invention comprises a coin validation apparatus which includes a coin chute defining a coin path and means for directing light across the coin path. The means comprises a light source for generating light and a control element for preventing light from being directed directly from the light source across the coin path. A light sensor is provided for sensing light directed across the coin path.

In another preferred form, the invention comprises a coin validation apparatus for evaluating coins and the like inserted therein and for validating acceptable coins. The coin validation apparatus includes a coin chute defining a coin path and means for evaluating the type of material of which the object in the coin chute is made of. The means for evaluating comprises coil sensor means positioned adjacent the coin path and a non-resonant electrical circuit for operation of the coil sensor means. The coin validation apparatus also includes means for directing light across the coin path and a light sensor for sensing light directed across the coin path. An electronic means is provided for evaluating an electromagnetic perturbation caused by an object moving past the coil sensor means and for determining the amount of light blocked by the object in the coin path by comparing the amount of light sensed by the light sensor with the object in the coin path with the amount of light sensed by the light sensor in the absence of an object in the coin path. The electronic means further compares the amount of light blocked by the object in the coin path and the electromagnetic perturbation with known values for valid coins to evaluate whether the object in the coin path is a valid coin.

In another form, the present invention comprises a coin validation apparatus as generally described above, and wherein the coin validation apparatus has a dynamic range of approximately 3:1.

In yet a further form of the invention, a method of evaluating an object in the coin path of a pay telephone using a coin validation apparatus having an optical sensor for evaluating physical characteristics of the object to determine whether the object is a valid coin. The method comprises the steps of (1) maintaining a microprocessor in a dormant state until a coin is deposited in the coin path; (2) once a coin has been deposited in the coin path, awakening the microprocessor from the dormant state and placing it in an active mode; (3) using the optical sensor to evaluate an object; (4) after the object has been evaluated, calibrating the optical sensor in preparation for a subsequent evaluation of an object; and (5) returning the microprocessor to its dormant state.

The method and apparatus according to the present invention have numerous advantages. Firstly, the inventive apparatus is elegantly simple and has very few moving parts. Indeed, in use, only one part moves. This results in an apparatus which is extremely rugged and reliable. Also, because of the elegantly simple construction, the apparatus is highly resistant to jamming. Moreover, because the apparatus looks at three different criteria or characteristics of the coin (diameter, thickness, and material composition) it can be highly accurate and precise in validating and discriminating coins. Further, the use of a single sensor to evaluate the diameter and another sensor to evaluate the thickness, as compared with prior art sensor arrays, allows much greater precision in such measurements. Also, the use of a single sensor for each of these measurements provides greater flexibility in the size of the coins. Indeed, units constructed according to the principles of the present invention have been made accepting coins from as small as 12 mm. all the way up to 35 mm. (a dynamic range of almost 3:1).

The present invention also is extremely flexible and can accommodate a large variety of valid coin types without requiring any mechanical reconfiguration. Also, the invention is suitable for use with coins having holes formed therein, as will be described below. Notably, the invention allows the apparatus to be operated at very low power levels while dormant, a considerable advantage in those situations where power is not available except through the telephone line. The invention also has tremendous accuracy in the field in use and is easily manufactured with a high degree of repeatability.

Accordingly, it is an object of the present invention to provide a coin validation apparatus which is simple, rugged, and jam-resistant.

It is another object of the present invention to provide a coin validation apparatus which is accurate and precise.

It is another object of the present invention to provide a coin validation apparatus which can accept a wide variety of coin sizes and has a large dynamic range.

It is another object of the present invention to provide a coin validation apparatus which is capable of validating a large number of coin types.

It is another object of the present invention to provide a coin validation apparatus which has a high sensitivity and which can be used to detect the presence of holes formed in coins.

It is another object of the present invention to provide a coin validation apparatus which, when dormant, operates at low power.

It is another object of the present invention to provide a coin validation apparatus which maintains good accuracy in use in the field and is easily manufactured with a high degree of repeatability.

These and other objects, features, and advantages of the present invention will become apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1B:
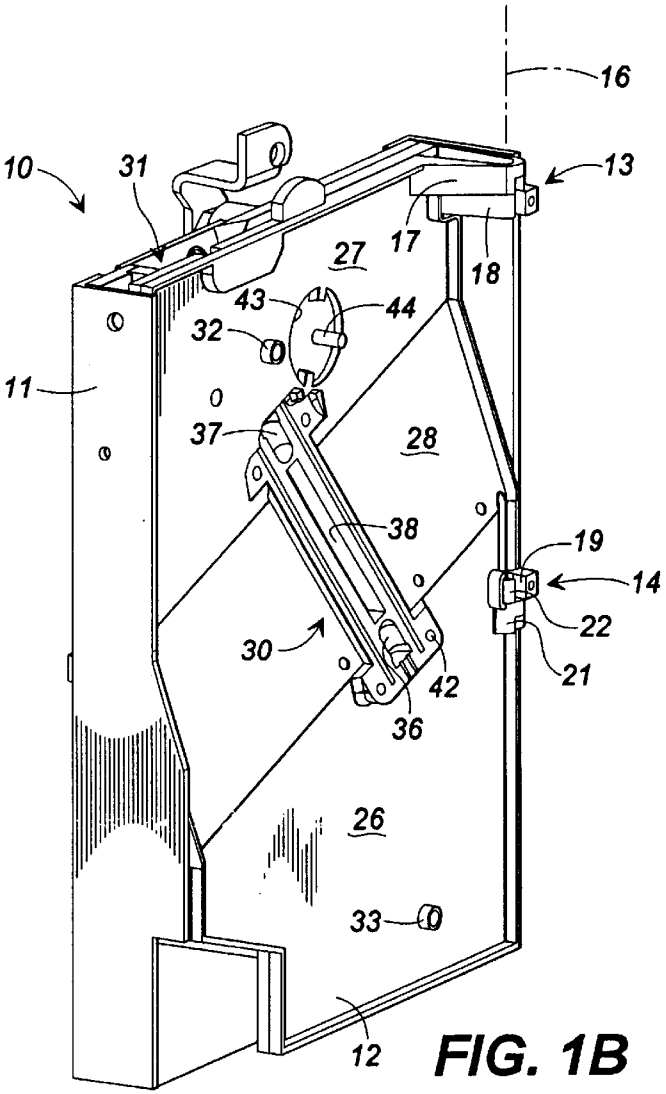
FIG. 1B is a perspective view of the coin validation apparatus of FIG. 1A, shown with some small components removed for clarity.
Figure 1A:
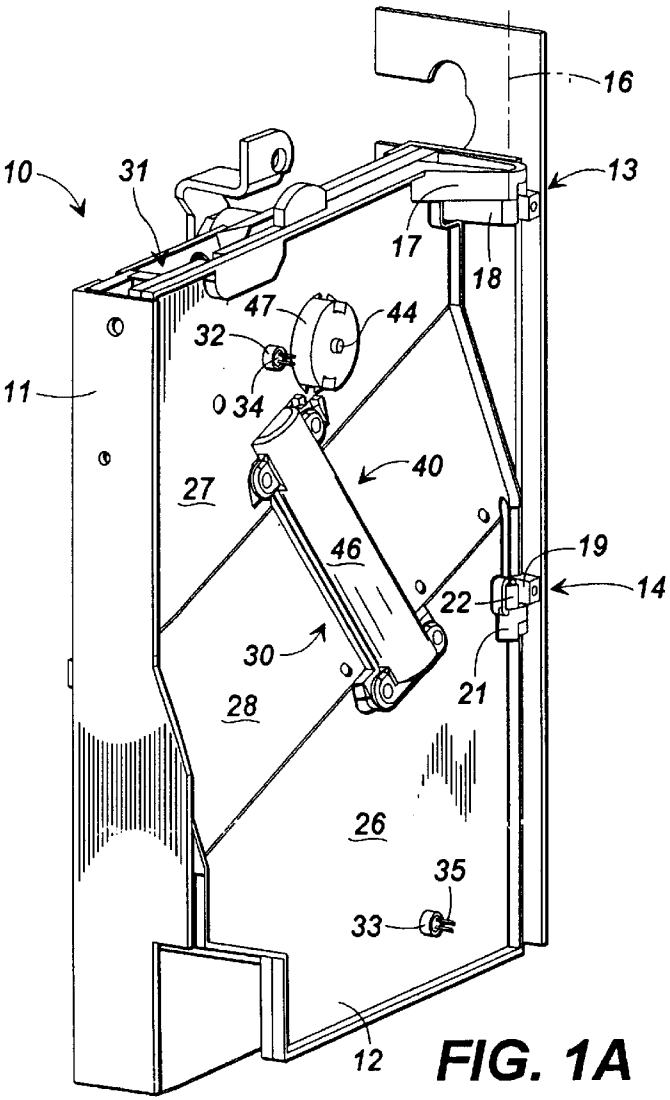
FIG. 1A is a perspective illustration of a coin validation apparatus according to a preferred form of the invention.
Figure 1D:
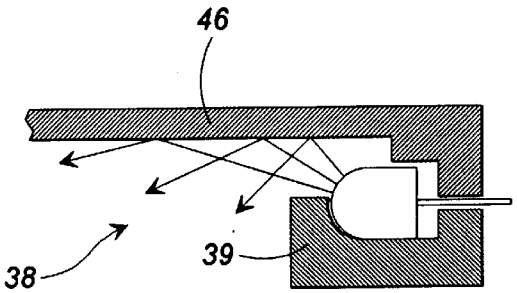
FIG. 1D is a sectional view of a portion of the coin validation apparatus of FIG. 1A.
Figure 1C:
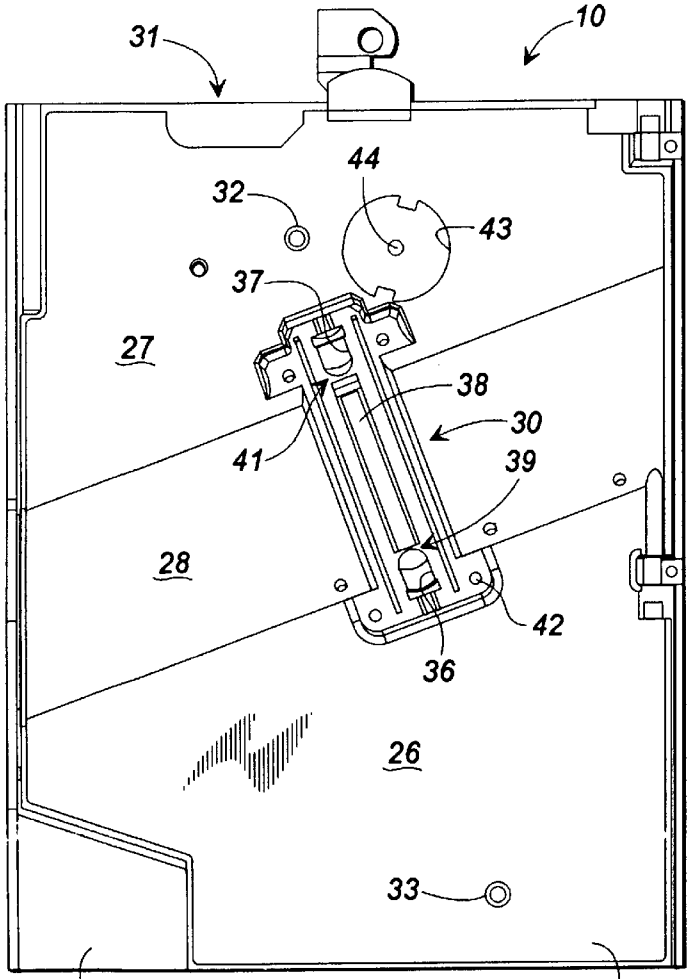
FIG. 1C is a front elevation view of the coin validation apparatus of FIG. 1A.

Referring now in detail to the drawing figures, wherein like reference numerals represent like parts throughout the several views, FIGS. 1A–1C show a coin validation apparatus 10 according to a preferred form of the invention. In FIGS. 1B and 1C, some of the small components have been removed in order to show other details that otherwise would be hidden from view. The coin validation apparatus 10 consists of two large chassis pieces hinged to one another. The apparatus includes a large chassis piece 11 and a second large chassis piece 12 which is hinged to the first chassis piece 11 by hinges indicated generally at 13 and 14. The hinges allow the second chassis piece 12 to pivot about hinge axis 16 in order to provide access to the interior of the coin validation apparatus. This function also releases any bent coin etc. that might stick. The hinges 13 and 14 include upper and lower hinge halves 17 and 18 and 19 and 21. The hinges also include hinge pins, such as hinge pin 22, which act as the axles.

Chassis piece 12 is molded from high-impact plastic and consists essentially of three flat sections including lower vertical section 26, upper vertical section 27, and an inclined section 28 extending from the lower section 26 to the upper section 27.

Together, the chassis pieces 11 and 12 define an entry slot generally indicated at 31 for admitting coins into the coin validation apparatus 10. The chassis piece 12 also includes bosses 32 and 33 for receiving an entry sensor 34 and an exit sensor 35. Furthermore, as will be seen in subsequent figures, the first chassis piece 11 has correspondingly placed bosses. The entry sensor comprises an LED emitter and a photo detector. Likewise, the exit sensor comprises an LED emitter and a photo detector.

The second chassis piece 12 is molded to receive a diameter sensor in the area generally indicated by reference numeral 30. As shown in FIG. 1A, the diameter sensor 40 includes a half-cylindrical reflector 46. As shown in FIGS. 1B and 1C, included therein are sockets 36 and 37 for receiving infrared LED emitters. An opening 38 extends from the outside surface of the chassis piece 12 all the way through the chassis piece 12 to the inside. The reader will note that as shown in FIGS. 1B–1D, the sockets shield the LEDs from directing their output through the aperture 38 directly. Rather, the light directed through the aperture 38 is indirect and diffuse. Indeed, there is a narrow, light blocking isthmus 39, 41 between the sockets 36, 37 and the aperture 38. The chassis piece 12 also includes four mounting holes, such as mounting hole 42 for securing the reflector element 46 over the LEDs and the aperture.

A recessed socket 43 and an upstanding post 44 are provided in the chassis piece 12 for receiving a magnetic coil 47.

Figure 2B:
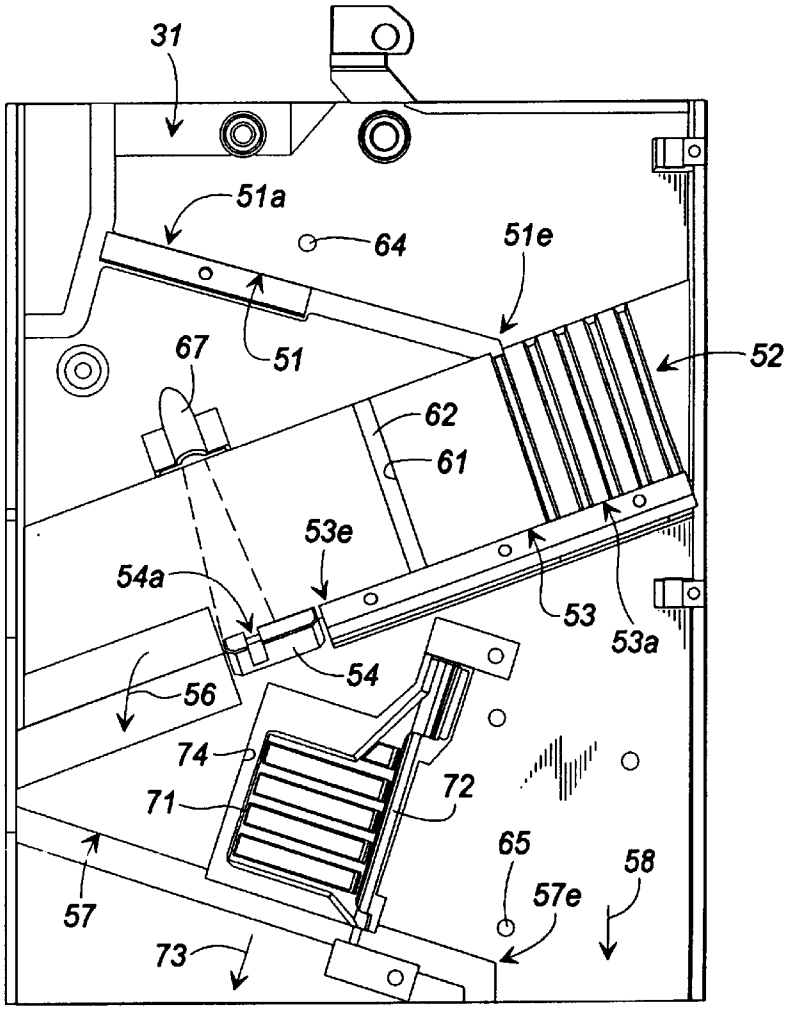
FIG. 2B is a front elevation view of the coin validation apparatus portion of FIG. 2A.
Figure 2A:
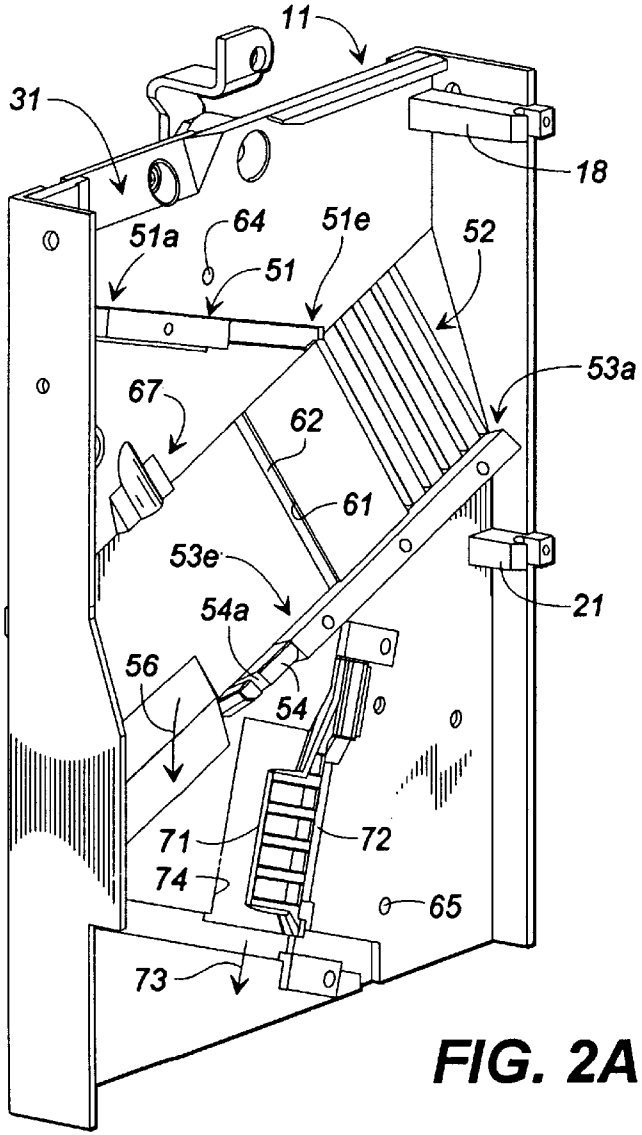
FIG. 2A is a perspective illustration of a portion of the coin validation apparatus of FIG. 1A.

Referring now to FIGS. 2A and 2B, chassis piece 11 can be considered in greater detail. Chassis piece 11 defines a coin path generally beginning at the entry slot 31 and extending straight downwardly to a first inclined coin ramp 51. First coin ramp 51 is oriented at a 20 degree angle with respect to horizontal so that after a coin is received through the coin slot 31 and impinges on first coin ramp 51 at location 51*a*, it rolls downwardly (to the right in FIGS. 2A and 2B) to the end 51*e* of the first coin ramp. With the chassis piece being made of high impact plastic, the first coin ramp 51 preferably comprises a metal insert to better absorb the shock and wear of metal coins impinging thereon and rolling thereby.

Water shed tracks generally indicated at 52 are positioned adjacent the end 51*e* of the first coin ramp 51 for peeling excess moisture off of the coins and transporting it away. Such water shed tracks are well-known in the industry.

The water shed tracks are adjacent a second coin ramp 53. Like first coin ramp 51, second coin ramp 53 includes a metal insert or wear plate for durability. Also like first coin ramp 51, second coin ramp 53 is angled at 20 degrees relative to the horizontal, although in this instance the orientation is reversed such that the coins falling off the end of the ramp 51*e* and across the water shed tracks 52 now impinge the second coin ramp in the vicinity of 53*a* and descend downwardly (to the left in FIGS. 2A and 2B). Adjacent the distal end 53*e* of the second coin ramp 52 is positioned a short ramp extension 54, which is aligned with and co-extensive with second coin ramp 53. As will be described more fully below, the ramp extension 54 serves as part of a thickness sensor. In this regard, the ramp extension 54 includes an opening or aperture 54*a*. After traversing ramp extension 54, the coin falls downwardly in the direction of direction arrow 56 toward third ramp 57. Like the other two ramps, third ramp 57 includes a metal insert for durability. Ramp 57 also is inclined at a 20 degree angle relative to horizontal and is parallel to first ramp 51. At the distal end 57*e* of third ramp 57, the coin path continues downwardly in the direction of direction arrow 58 (for the coin return path).

Referring now again to the top of the aforedescribed coin path, a detector 64 is positioned in the entry path and is directly opposite the LED emitter 34. Together, the LED emitter 34 and the detector 64 comprise an entry sensor to indicate when a coin has crossed through the entry slot 31 and has begun down the coin ramp 51. Likewise, a detector 65 is positioned near the exit and opposite the LED emitter 35 of the chassis piece 12. Together, the LED 35 and sensor 65 make up an exit sensor to indicate that a coin has been passed to the coin box (unshown in the figures).

Intermediate the ends of the second ramp 53, an opening or aperture 61 is formed in the chassis piece 11 adjacent the coin path. The aperture 61 lies adjacent a large area detector 62 and shrouds all but a narrow strip thereof. Together with the LEDs and the half-cylindrical reflector positioned in the chassis piece 12, the aperture 61 and the wide area detector 62 make up a diameter sensor positioned along the coin path. Like the coin path, the diameter sensor is adapted to accept coins up to 35 millimeters in diameter. That is to say, measured lengthwise, the wide area detector exceeds 35 millimeters in length.

Downstream of the diameter detector, a thickness sensor is positioned along the coin path and generally comprises a hooded light source generally indicated at 67 and a wide area detector positioned beneath ramp extension 54. In this way, light shining from the hooded light source 67 across the coin path impinges upon the ramp extension 54 and only a small sliver of it extends through the aperture 54*a* and impinges upon the detector element positioned beneath the ramp extension 54. If desired, a grating or gridlines can be provided between the light source 67 and the detector beneath the ramp extension 54, with the gridlines or grating running parallel to the second ramp 53. With the grating or gridlines extending parallel to the ramp, they extend perpendicularly to the path of light from the light source to the wide area detector. This has the effect of minimizing "skimming" or reflecting light that otherwise would be reflected off the surface of the chassis piece 11. Also, by using the slot-like aperture 54*a*, most stray light is prevented from reaching the wide area detector beneath the ramp extension 54 and essentially only light from the hooded light source 67 reaches the wide area detector.

Positioned along third ramp 57 is a low-mass gate 71 which pivots about a pivot axle 72. The gate normally is in a closed position wherein coins are shunted off to a reject chute in the direction of direction arrow 73 (coins actually fall on the other side of the chassis piece 11, not on the side visible in FIGS. 2A and 2B). With the gate in its normally closed position, coins traveling down ramp 57 impinge on the gate 71 and bounce through reject exit door 74.

Figure 3B:
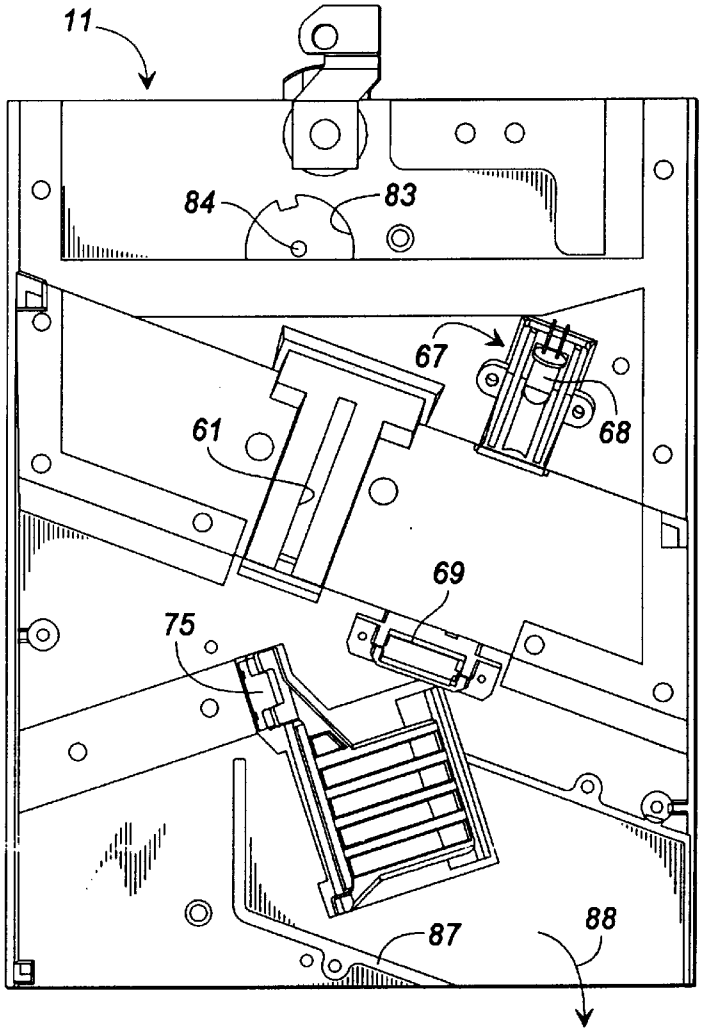
FIG. 3B is a rear elevation view of the coin validation apparatus of FIG. 1A.
Figure 3A:
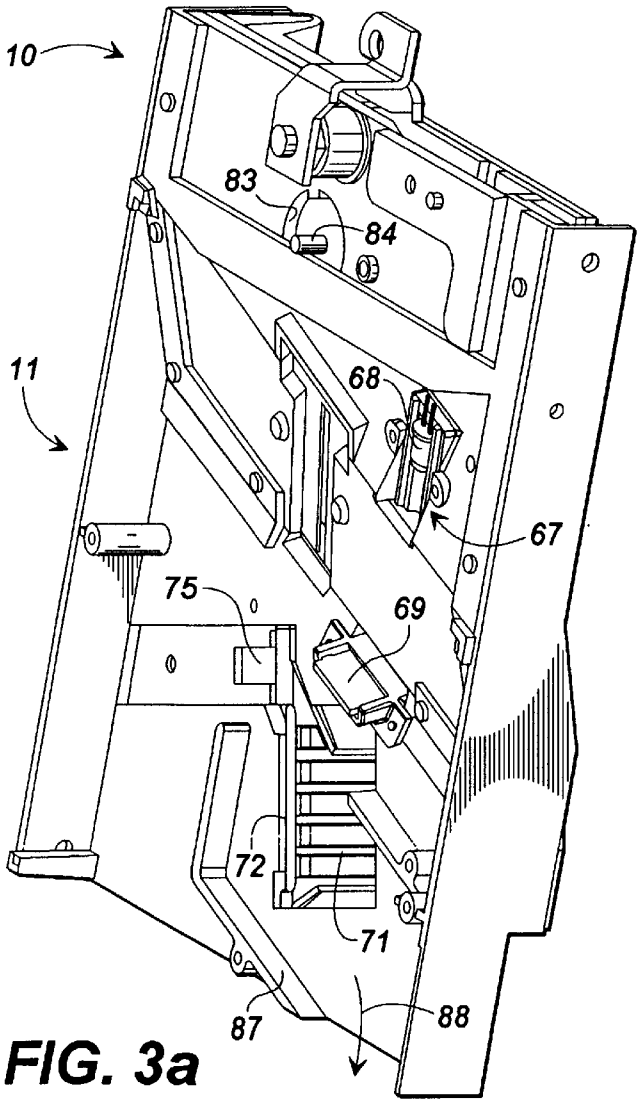
FIG. 3A is a perspective, rear view of the coin validation apparatus of FIG. 1A.

FIGS. 3A and 3B show the back side of the chassis piece 11. Moreover, some of the small components are removed in these figures for clarity of illustration. For example, the hooded light source generally indicated at 67 is shown with half of the light tube or shroud removed to show the location of the LED 68 positioned therein. Likewise, the wide area detector used to measure the diameter of the coins is removed in FIGS. 3A and 3B to better show the aperture 61.

The wide area detector previously discussed in connection with the ramp extension 54 can be seen in FIG. 3A. In particular, the wide area detector 69 can be seen as extending from the back side of chassis piece 11 through the chassis piece to the other side where it extends beneath the ramp extension 54.

FIGS. 3A and 3B also show a recessed socket 83 and a post 84 for receiving a coil. This coil together with coil 47 positioned in the other chassis piece are used to determine the material composition of coins rolling along the coin path.

As best seen in 3A and 3B, the gate 71 includes an arm 75, which is rigidly formed with or secured to the remainder of the gate and is used to pivot the gate one way or the other about the pivot axle 72. An electromagnet (unshown in this figure) is used to selectively attract the arm 75 to open the gate when needed. Otherwise, the gate is held in its closed position by a spring (unshown in the figures). Positioned beneath the gate 71 on the back side of chassis piece 11 is a reject ramp 87 for directing coins from the gate to a reject chute in the direction of direction arrow 88. Once assembled, much of the back side of chassis piece 11 is covered with an printed circuit board housing the electronics which control operation of the coin validator.

Figure 5:
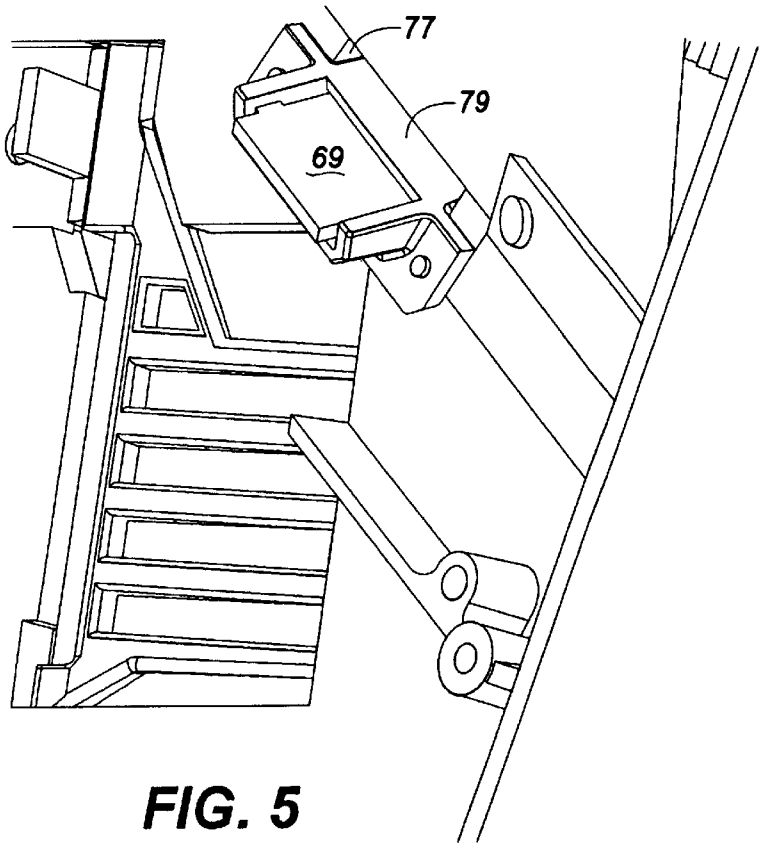
FIG. 5 is a detailed perspective illustration of another portion of the coin validation apparatus of FIG. 1A.
Figure 4:
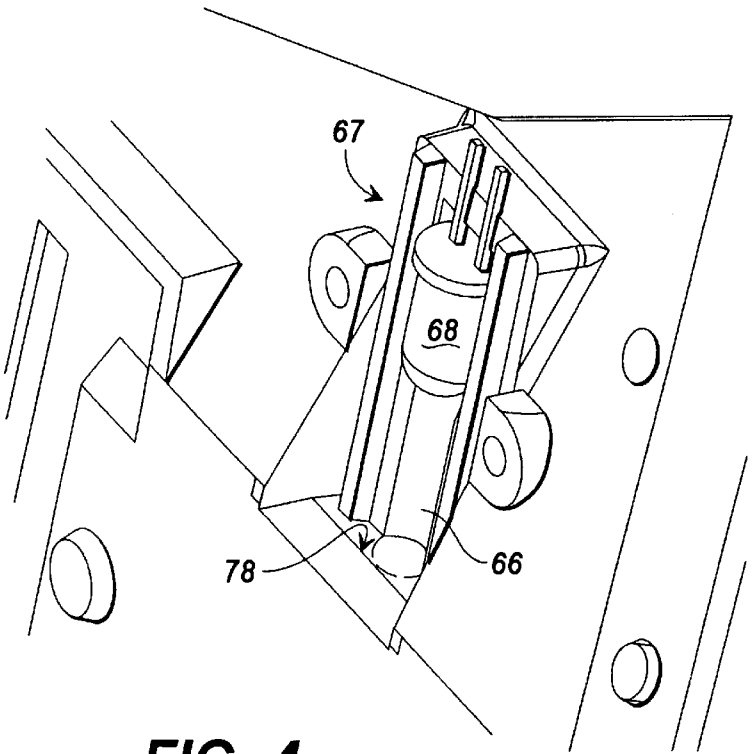
FIG. 4 is a detailed perspective illustration of a portion of the coin validation apparatus of FIG. 1A.
Figure 6:
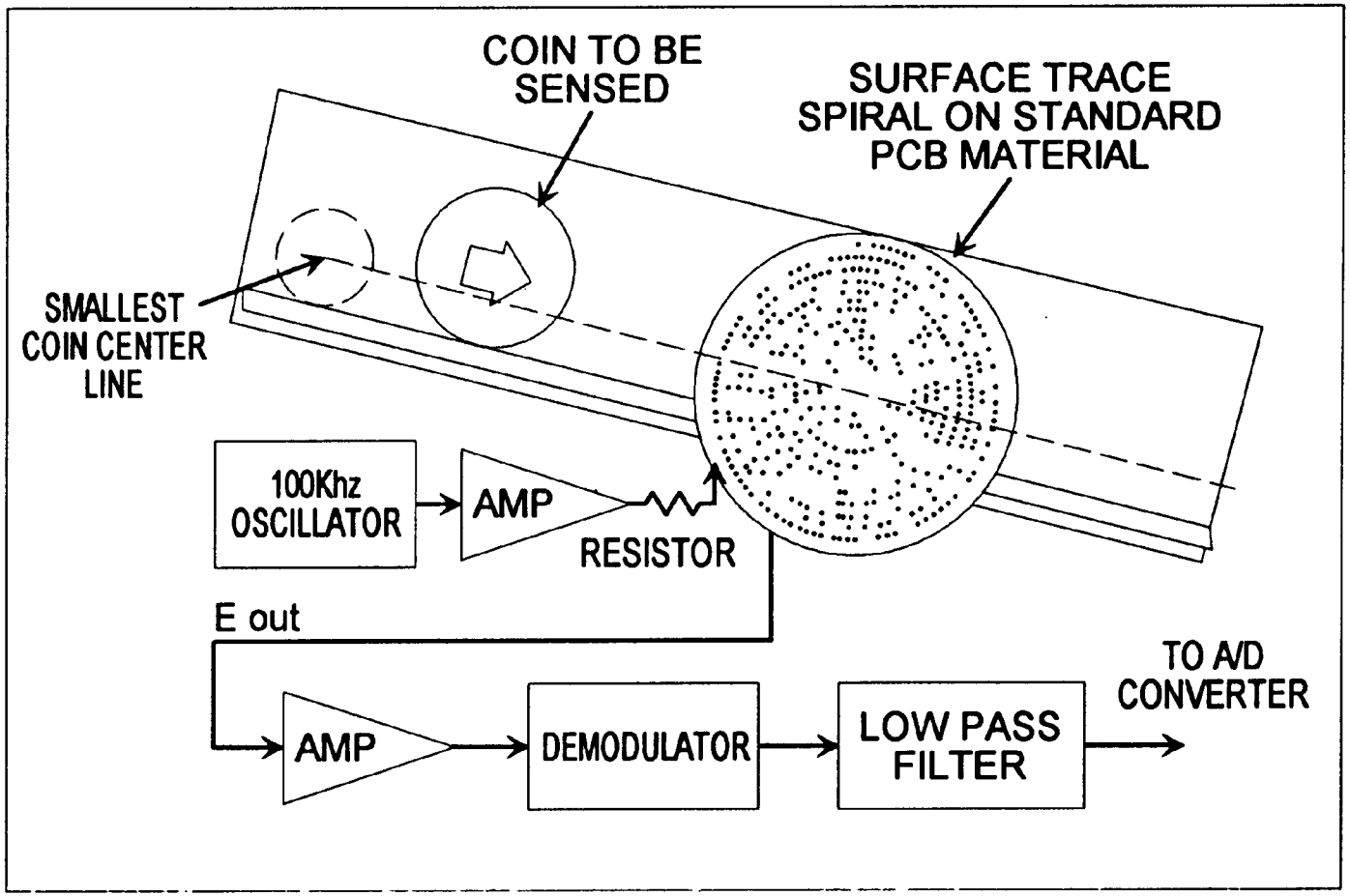
FIG. 6 is a schematic illustration of a part of the apparatus of FIG. 1 and the operation thereof.
Figure 7:
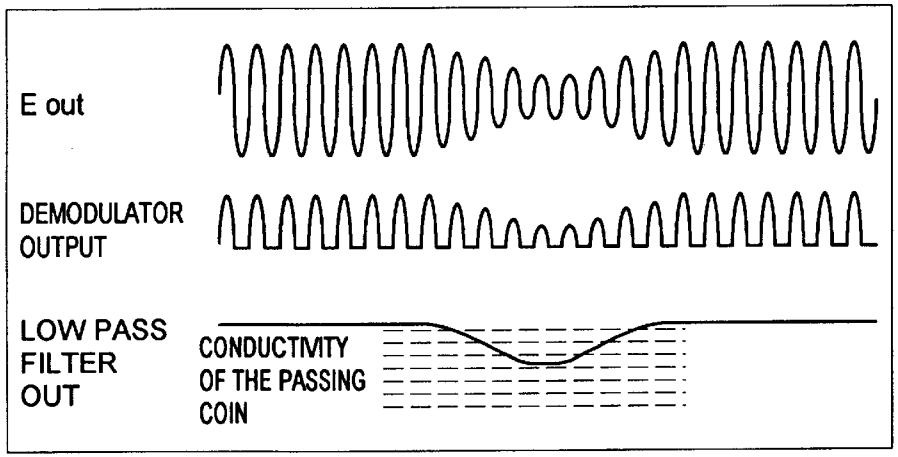
FIG. 7 is a schematic illustration of operation of a part of the apparatus of FIG. 1.

Referring now to FIG. 4, the hooded light source 67 can be seen in greater detail. As seen therein, the light source includes an LED 68 snugly held in the socket. A cylindrical collimating tube is formed in part by the socket shown in FIG. 4 and in part by a cover or mating half omitted from this figure for clarity. As can be seen in FIG. 4, the socket includes a half-cylindrical surface 66 which, when mated with the other half's cylindrical surface, results in a substantially cylindrical tube which tends to collimate the light output from the LED for directing it across the coin path towards the wide area detector 69. FIG. 4 shows the light source 67 from the back side of the chassis piece 11 and depicts that the light coming from the light source lies closely adjacent to the inside surface indicated at 78 of the chassis piece 11 along the coin path. FIG. 5 shows that the wide area detector 69 is fitted within a mounting tray 79 which extends through an opening or aperture 77 formed in the chassis piece The magnetic coils operate to sense the metallic signal out of the coins as follows. The coils are placed as close to the coin path as possible to allow the coins to pass very close to the magnetic field. To ensure consistent position and orientation, the coin path is tilted. The coin can roll or slide by the sensor and the output from the sensor is essentially unaffected thereby. The coils are operative for measuring the conductivity of the surface material from the coins. FIG. 6 shows the general period of operation of the magnetic coils in blocked, schematic form. FIG. 7 shows the outputs measured from the coils in raw form, demodulated, and after a low pass filter. As the coin passes between the coils, a change in the coupling between coils occurs that is proportional to the surface current in the coin. Most coins cause the value to decrease, but metallic objects that have magnetic properties exhibit an increase in coupling, making the signal actually increase. The drive frequency is crystal controlled such that the amplitude of the signal coming out of the sensor coil is in the sloped part of the coupling curve; therefore, changes in coupling cause a corresponding change in the amplitude of the oscillator sine wave when the coin passes between the coils. That is, the signal "E-out" is demodulated with a diode demodulator, then a low pass filter rolling off around 400 hz to keep the effects of coin speed to a minimum. The resulting signal is fed to analog to digital (AD) converter for the main controller to use with the diameter and thickness information for rejection of improper coins or slugs. This technique has the advantages of low cost, being independent of coin speed and acceleration, and is used only when needed, thereby lowering the power requirements. It also very temperature tolerant and humidity resistant and is very repeatable from one unit to the next.

Figure 8:
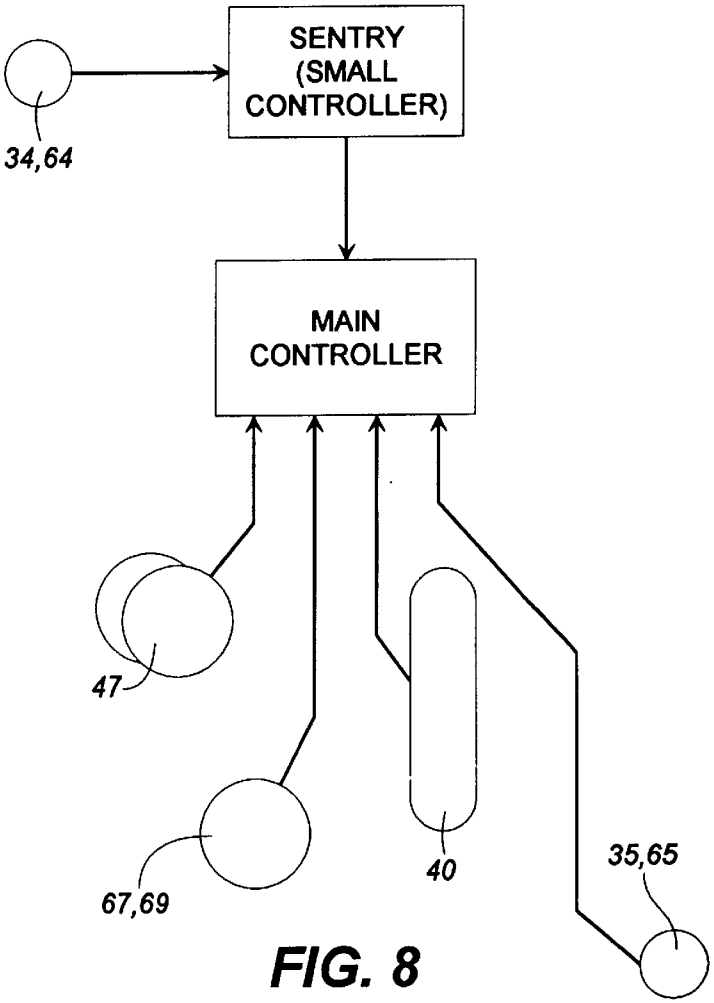
FIG. 8 is a schematic block diagram of a portion of the apparatus of FIG. 1.

As shown in FIG. 8, the coin validation apparatus is microprocessor controlled. In fact, two microprocessors are used and located on the printed circuit board. The smallest (least powerful and least power consuming) microprocessor serves as an entry detector. It receives signals from the entry sensor and when it detects that a coin has entered the coin validator, it sends a signal to the larger microprocessor (the main controller). This causes the main controller to leave its dormant state and become active (it normally lies in a dormant state to conserve power). Once the main controller is active, it begins gathering data electronically from the sensors indicating the material composition, the diameter, and the thickness of the coin. It then analyzes the gathered data from these tests to determine whether to accept the coin or reject it. Thereafter, baseline values are run using the same sensors without a coin present to calibrate the sensors and prepare them for the next coin. The main controller then returns to the dormant state after the coin exits the scanner. The self-calibration, which occurs after handset removal and every coin drop, compensates for environmental changes, such as a change in temperature. This allows the scanner to adapt to its environment, even if its environment goes through large changes in temperature, humidity, etc.

OPERATION

The coin validation apparatus is a coin testing device used for accepting authentic coins and rejecting slugs. It performs a series of tests that gather data electronically and compare the data to pre-established criteria. The validation apparatus has the ability to store up to 16 coin sets, of which 8 can be active at any one time. In operation, a coin enters the coin validation apparatus through entry slot 31. Once the coin enters the coin validation apparatus, the entry detector detects the presence of the coin and sends a signal to activate the large microprocessor (the main controller). The coin next travels along a track where three tests are performed to verify that the coin is authentic. Firstly, test data is gathered using the magnetic coils to establish a metallic signature (metal composition) of the coin. This is done using the two coils, such as coil 47. These coils create a magnetic field and when the coin passes through the field, it creates a disturbance. The disturbance is analyzed and compared with known disturbance patterns for known, valid coins.

Secondly, information is gathered about the diameter of the coin and the possibility of a hole being in the coin. The coin passes the diameter sensor which uses the light emitting diodes and the half-cylindrical reflector along with the wide area detector (solar cell). The solar cell collects the amount of infra-red light from the diodes as the coin passes and is compared with known data for established, valid coin types.

The third test involves gathering information about the thickness of the coin. Again, infra-red light from the diode in the thickness sensor is collected by the wide area detector. Of course, the thicker the coin, the greater the amount of light that is blocked. The amount of light collected on the wide area detector is compared with stored criteria for established coins. It should be noted that the order of the tests is not critical.

If the data gathered is within the range of preexisting criteria, the coin is accepted as a valid coin. If so, the main controller sends a signal to the electromagnet to open the gate 71 (alternatively, a permanent magnet can be used and manipulated with a "motor" field). The gate is then opened by the electromagnet to accept the coin. The coin then passes the gate and is detected by the exit detector. The exit detector generates a signal that informs the main controller that the coin has existed the scanner. The main controller then sends a signal to the pay phone which identifies the value of the accepted coin. The main controller then calibrates the sensors to establish a new baseline for the current, local conditions and then returns to the dormant state.

As the coin moves by the diameter detector, the light received by the large area detector is reduced in proportion. The maximum reduction represents the diameter of the coin, as the maximum reduction occurs when the coin's maximum diameter passes by the slot. The microprocessor controlling the system then can sense the minimum detector output and store the diameter of the coin.

This module also allows the system to sense the presence of holes in coins. The hole is easily detected to allow the system to know the hole is present. This information can be utilized to reject all coins with holes, or to accept coins with holes in those counties that have coins with holes. As the coin passes over the detector aperture 19, the wide area detector senses the amount of light that is blocked, which is proportional to the thickness of the coin. The microprocessor reads the signal and saves the minimum value of the light received, which is proportional to the thickness of the coin. The microprocessor also controls the light source and can therefore calibrate the module before reading the thickness value of the coin. This allows compensation for any variations due to temperature, humidity, or aging of the light source or detector.

If the coin falls outside the established criteria, the coin is rejected by simply allowing the gate to remain in its closed position, and when the coin encounters the gate, it is knocked off track and rejected.

The coin validation apparatus is especially suitable for handling large coins. The maximum coin size of a commercial embodiment of the present invention is 35 millimeters in diameter and 4 millimeters in thickness. Moreover, the coin validation apparatus is particularly adept at preventing coin jams. The three main features that prevent coin jams are a steeply angled track, one main track (as opposed to multiple possible tracks), and only one moving part (the gate). The steeply angled track reduces coin jams by accelerating a coin at a rate that reduces the chances of the coin stopping. The feature of having only one main track reduces coin jams by not diverting the coin into several different tracks which could result in a coin hanging up at such a juncture. The feature of one moving part (the gate) reduces coin jams by reducing the number of moving parts that can possibly obstruct the coin's path.

There are many advantages of this coin validation apparatus such as:

a No lenses or critical focus parameters b Independent of coin speed or acceleration c Coins do not have to be round d One moving part e Large dynamic range of coin diameters f Large coin path g No jam points, pivots, mechanical levers or cams h Long service life I Self Calibration j Built in test to alert operators of impending problems before actual failure k Non precision optical alignment l Low Power Design m Off the shelf components, inexpensive to manufacture n Downloadable in the field o Easily adapted to other products One particularly nice feature among those listed above is the ability to download new coin parameters to the coin validation mechanism while it is in the field. This is accomplished by contacting the coin validation mechanism via the phone line and reprogramming the parameters contained in the microprocessor.

While the invention has been disclosed in preferred forms, it will be apparent to those skilled in the art that many modifications, additions, and deletions can be made therein without departing from the spirit and scope of the invention as defined in the following claims.

What is claimed is:

1. A coin validation apparatus, such as for use with a pay telephone, comprising:

a coin chute defining a coin path;

a first light source for directing light across said coin path in a first direction substantially perpendicular to said coin path;

a first light sensor for sensing light directed across said coin path;

said first light source comprising at least one light emitting element and a reflector for collecting light from said light emitting element and reflecting it toward said first light sensor;

a second light source for directing light across said coin path in a second direction substantially perpendicular to said first direction;

a second light source for sensing light directed across said coin path from said second light source; and electronic means for determining the amount of light blocked by an object in said coin path by comparing the amount of light sensed by said first and second light sensors with an object in said coin path with the amount of light sensed by said light sensors in the absence of an object in said coin path, said electronic means further comparing the amount of light blocked by the object in said coin path with known values for valid coins to evaluate whether the object in said coin path is a valid coin.

2. A coin validation apparatus as claimed in claim 1 wherein said coin chute and said second light source are arranged such that light is directed toward a rim of an object in said coin path.

3. A coin validation apparatus as claimed in claim 1 wherein said coin chute and said first light source are arranged such that light is directed toward a face of an object in said coin path.

4. A coin validation apparatus as claimed in claim 1 wherein said electronic means evaluates the amount of light blocked by the object in the coin path to evaluate the diameter of the object in the coin path.

5. A coin validation apparatus as claimed in claim 2 wherein said electronic means evaluates the amount of light blocked by the object in the coin path to evaluate the thickness of the object in the coin path.

6. A coin validation apparatus as claimed in claim 1 and having a dynamic range at least as great as about 3 to 1.

7. A coin validation apparatus as claimed in claim 1 and having a dynamic range of from about 12 mm. to about 35 mm.

8. A coin validation apparatus as claimed in claim 1 where said electronic means comprises first and second microprocessors, with said second microprocessor being responsive to the presence of an object in said coin chute for controlling operation of said first microprocessor, such that said first microprocessor is maintained in a dormant, low-power state in the absence of an object in said coin chute.

9. A coin validation apparatus as claimed in claim 1 further comprising means for evaluating the type of material of which the object in the coin chute is made of, said means for evaluating comprising coil sensor means positioned adjacent said coin path and a non-resonant electrical circuit for operation of said coil sensor means.

10. A coin validation apparatus as claimed in claim 1 wherein said first light source comprises means for directing a thin strip of light across said coin path.

11. A coin validation apparatus as claimed in claim 10 wherein light output from said first light source is prevented from traveling directly from said light emitting element to said first light sensor.

12. A coin validation apparatus as claimed in claim 1 wherein said second direction is substantially perpendicular to said coin path.

13. A coin validation apparatus, such as for use with a pay telephone, for evaluating coins and the like inserted therein and for validating acceptable coins, said coin validation apparatus comprising:

a coin chute defining a coin path;

means for directing light across said coin path and at a rim of an object in said coin path, said means including a first light source and control means for preventing light from said first light source from traveling directly from said first light source across the coin path;

a light sensor for sensing light directed across said coin path;

second means including a second light source and second control means for preventing light from said second light source from traveling directly from said second light source directly across the coin path;

a second light sensor for sensing light directed across said coin path; and electronic means for determining the amount of light blocked by a rim of the object in said coin path and by a face of the object in the coin path by comparing the amount of light sensed by said light sensors with the object in said coin path with the amount of light sensed by said light sensors in the absence of an object in said coin path to determine a thickness and a diameter of the object, said electronic means further comparing the amounts of light blocked by the object in said coin path with known values for valid coins to evaluate whether the object in said coin path is a valid coin.

14. A coin validation apparatus as claimed in claim 13 wherein said light source directs light across said coin path in a first direction which is perpendicular to said coin path.

15. A coin validation apparatus as claimed in claim 13 wherein an average thickness of the object in said coin path is determined by taking multiple thickness measurements along the length of the object as the object rolls along past said light sensor.

16. A coin validation apparatus as claimed in claim 13 wherein said light source directs light in a direction which is perpendicular to the rim of the object in said coin path.

17. A coin validation apparatus as claimed in claim 16 wherein light directed from said light source also is perpendicular to said coin path.

18. A coin validation apparatus as claimed in claim 13 wherein said electronic means comprises first and second microprocessors, with said second microprocessor being responsive to the presence of an object in said coin chute for controlling operation of said first microprocessor, such that said first microprocessor is maintained in a dormant, low-power state in the absence of an object in said coin chute.

19. A coin validation apparatus as claimed in claim 13 further comprising means for evaluating the type of material of which the object in said coin chute is made of, said means for evaluating comprising coil sensor means positioned adjacent said coin path and a nonresonant electrical circuit for operation of said coil sensor means.

20. A coin validation apparatus, such as for use with a pay telephone, comprising:

a coin chute defining a coin path;

means for directing light across said coin path, said means comprising a light source positioned to one side of said coin path for generating light and a control element for preventing light so generated from being directed from said light source directly across said coin path, wherein said means for directing provides an elongated strip of light; and a light sensor positioned adjacent a second side of said coin path for sensing light directed across said coin path, wherein said light sensor is elongate for sensing said strip of light.

21. A coin validation apparatus as claimed in claim 20 wherein said means for directing a thin strip of light comprises at least one light emitting element and a reflector means for collecting light from said light emitting element and for reflecting it toward said light sensor.

22. A coin validation apparatus as claimed in claim 20 wherein said control element comprises a shroud for shrouding said light sensor from viewing said light source directly.

* * * * *